US009453376B1

(12) United States Patent
Raymond

(10) Patent No.: US 9,453,376 B1
(45) Date of Patent: Sep. 27, 2016

(54) SELF-ASSEMBLING SEGMENTED COILED TUBING

(75) Inventor: David W. Raymond, Edgewood, NM (US)

(73) Assignee: Sandia Corporation, Albuquerque, NM (US)

( * ) Notice: Subject to any disclaimer, the term of this patent is extended or adjusted under 35 U.S.C. 154(b) by 921 days.

(21) Appl. No.: 12/371,696

(22) Filed: Feb. 16, 2009

Related U.S. Application Data

(60) Provisional application No. 61/121,045, filed on Dec. 9, 2008.

(51) Int. Cl.
*E21B 17/20* (2006.01)
*E21B 17/05* (2006.01)
*E21B 17/07* (2006.01)

(52) U.S. Cl.
CPC ..... *E21B 17/20* (2013.01); *E21B 17/05* (2013.01); *E21B 17/07* (2013.01); *Y10T 403/32819* (2015.01)

(58) Field of Classification Search
USPC ..... 403/56, 90, 144–146, 129, 131, 136, 403/138, 111; 138/120, 155; 285/146.1–146.3, 147.2, 267, 268, 285/269; 166/242.6, 77.2; 175/320; 464/18, 464/19, 20, 21
See application file for complete search history.

(56) References Cited

U.S. PATENT DOCUMENTS

| | | | | |
|---|---|---|---|---|
| 2,680,358 | A * | 6/1954 | Zublin | 464/19 |
| 2,696,264 | A * | 12/1954 | Colmerauer et al. | 166/235 |
| 3,197,552 | A * | 7/1965 | Flair | 174/86 |
| 3,456,514 | A * | 7/1969 | Gebendinger | 74/110 |
| 4,062,412 | A * | 12/1977 | McIlvanie | 175/57 |
| 5,437,480 | A * | 8/1995 | Weil | 285/146.3 |
| 5,547,032 | A * | 8/1996 | Wenzel | 175/73 |
| 6,203,435 | B1 * | 3/2001 | Falgout, Sr. | 464/18 |
| 6,672,788 | B2 * | 1/2004 | Hathaway | 403/90 |
| 6,684,954 | B2 * | 2/2004 | George | 166/297 |
| 6,846,022 | B2 * | 1/2005 | Takagi | 285/146.1 |
| 7,165,635 | B2 * | 1/2007 | Kauffman et al. | 175/320 |
| 2009/0127000 | A1 * | 5/2009 | Cousins et al. | 175/78 |

* cited by examiner

*Primary Examiner* — Matthieu Setliff
(74) *Attorney, Agent, or Firm* — Daniel J. Jenkins

(57) ABSTRACT

Self-assembling segmented coiled tubing is a concept that allows the strength of thick-wall rigid pipe, and the flexibility of thin-wall tubing, to be realized in a single design. The primary use is for a drillstring tubular, but it has potential for other applications requiring transmission of mechanical loads (forces and torques) through an initially coiled tubular. The concept uses a spring-loaded spherical 'ball-and-socket' type joint to interconnect two or more short, rigid segments of pipe. Use of an optional snap ring allows the joint to be permanently made, in a 'self-assembling' manner.

22 Claims, 13 Drawing Sheets

SELF-ASSEMBLING SEGMENTED COILED TUBING

CROSS-REFERENCE TO RELATED APPLICATIONS

This application claims the benefit of U.S. provisional patent application Ser. No. 61/121,045 filed Dec. 9, 2008, which is incorporated herein by reference.

FEDERALLY SPONSORED RESEARCH

The United States Government has rights in this invention pursuant to Department of Energy Contract No. DE-AC04-94AL85000 with Sandia Corporation.

BACKGROUND OF THE INVENTION

The present invention relates generally to drilling and drillstring equipment for oil and gas drilling, water well drilling, geothermal drilling, etc.

Most traditional drillstrings are constructed of straight sections of rigid pipe (i.e., 'rigid tubulars') interconnected (i.e., joined) by threaded joints. The pipe is typically manufactured with a thick wall section to allow it to convey large mechanical loads.

Coiled tubing is also used for drillstring tubulars. Its advantage is it can be transported to the drill site in long lengths (wrapped around a large spool) and readily deployed into the well. It is typically manufactured with a thinner wall than rigid pipe because it must be transported by wrapping the tubing around a spool (typical spool diameter ranges from 4-8 ft). It is deployed into the well by un-coiling it from the spool into a linear section, and then bending it over a gooseneck and down into the well. Coiled tubing typically has a wall thickness of 3/32-3/16 inches thick, and outer diameter about 2-3 inches (e.g., 2.5 inches). Coiled tubing has material limitations in how tightly it can be wound on the spool. It also requires large forces to deploy it from the wound condition.

Traditional thick-walled jointed pipe offers the benefit of a tubular with greater strength; while thin-walled coiled tubing offers the benefit of rapid deployment.

The segmented coiled tubing concept of the present invention is a system that provides the benefits of both jointed pipe and coiled tubing. It eliminates the bending operation during unwinding, it can self-assemble, and it acts like rigid pipe once assembled.

Against this background, the present invention was developed.

SUMMARY OF THE INVENTION

Self-assembling segmented coiled tubing is a concept that allows the strength of thick-wall rigid pipe, and the flexibility of thin-wall tubing, to be realized in a single design. The primary use is for a drillstring tubular, but it has potential for other applications requiring transmission of mechanical loads (forces and torques) through an initially coiled tubular. The concept uses a spring-loaded spherical 'ball-and-socket' type joint to interconnect two or more short, rigid segments of pipe. Use of an optional snap ring allows the joint to be permanently made, in a 'self-assembling' manner.

BRIEF DESCRIPTION OF THE DRAWINGS

The accompanying drawings, which are incorporated in and form part of the specification, illustrate various examples of the present invention and, together with the detailed description, serve to explain the principles of the invention.

LIST OF NUMBERED FEATURES REFERENCES IN FIGURES

8—spool
10—rigid pipe segment
12—adjacent rigid pipe segment
13—coil spring
14—connecting link
16—ball
17—internal shoulder of rigid pipe segment for retaining spring
18—socket
20—internal snap ring groove
22—external snap ring groove
24—spherical joint
26—snap ring
30—front-facing contact surface of rigid pipe segment
32—outer tapered sliding surface at insert end of socket
34—inner sliding surface of rigid pipe segment
36—rear-facing contact surface of socket
37—internal spherical bearing surface of socket
39—male insert end of rigid pipe segment

40—internal spherical bearing surface of rigid pipe segment
41—end plane of the rear end of second rigid pipe segment
42—spring-retaining external shoulder (flange) of connecting tube
44—internal bore of ball
50—continuous tube insert
60—rigid pipe segment
62—rigid pipe segment
64—rigid pipe segment
66—spherical ball joint
68—spherical ball joint
70—slanted mating contact surface
72—slanted mating contact surface
$D_1$=larger inner diameter of rigid pipe segment
$D_2$=smaller inner diameter of rigid pipe segment
$D_3$=inner diameter of connecting tube

DETAILED DESCRIPTION OF THE INVENTION

Figure 1:
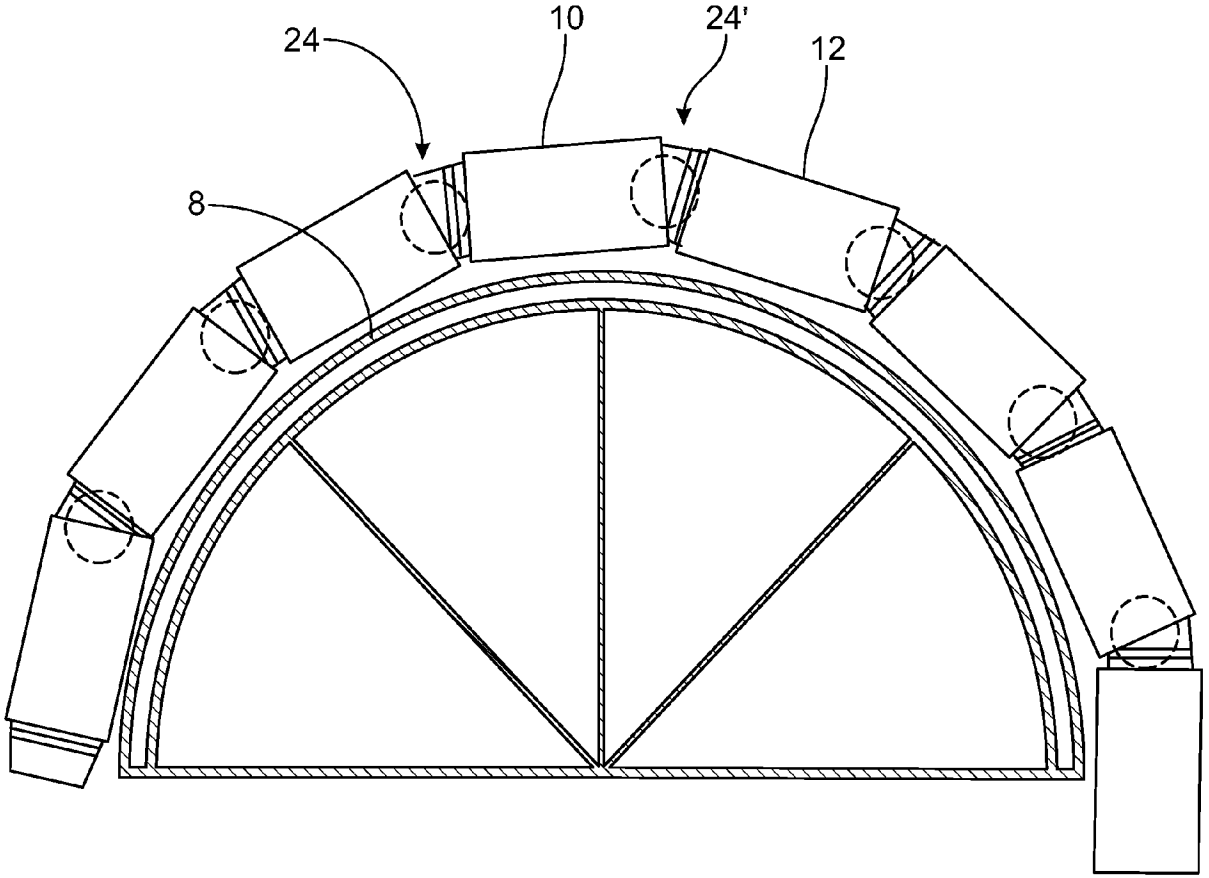
FIG. 1 is a representation of rigid tubulars (pipe segments), wound around a spool, in their axially displaced and rotated configuration, allowing the spherical joint to become active.

FIG. 1 is a representation of the present invention, comprising a series of short, rigid segments of pipe 10, 12 (i.e., rigid tubulars) interconnected by a hidden, spring-loaded spherical 'ball-and-socket' type joint 24. The interconnected set of two (or more) rigid tubulars are circumscribed around the periphery of a spool 8 in a pre-assembled (i.e., displaced) configuration. Axial displacement of the spring-loaded spherical joint 24 allows rotation between adjacent segments 10 and 12 about an infinite number of axes; thereby allowing the segmented tube/pipe segments to be helically coiled on the spool. Activation of the spherical joints allow rotation of the individual pipe sections relative to one another, thereby allowing, for example, the individual pipe sections to circumscribe the periphery of a mounting spool in a piece-wise smooth fashion.

Figure 2:
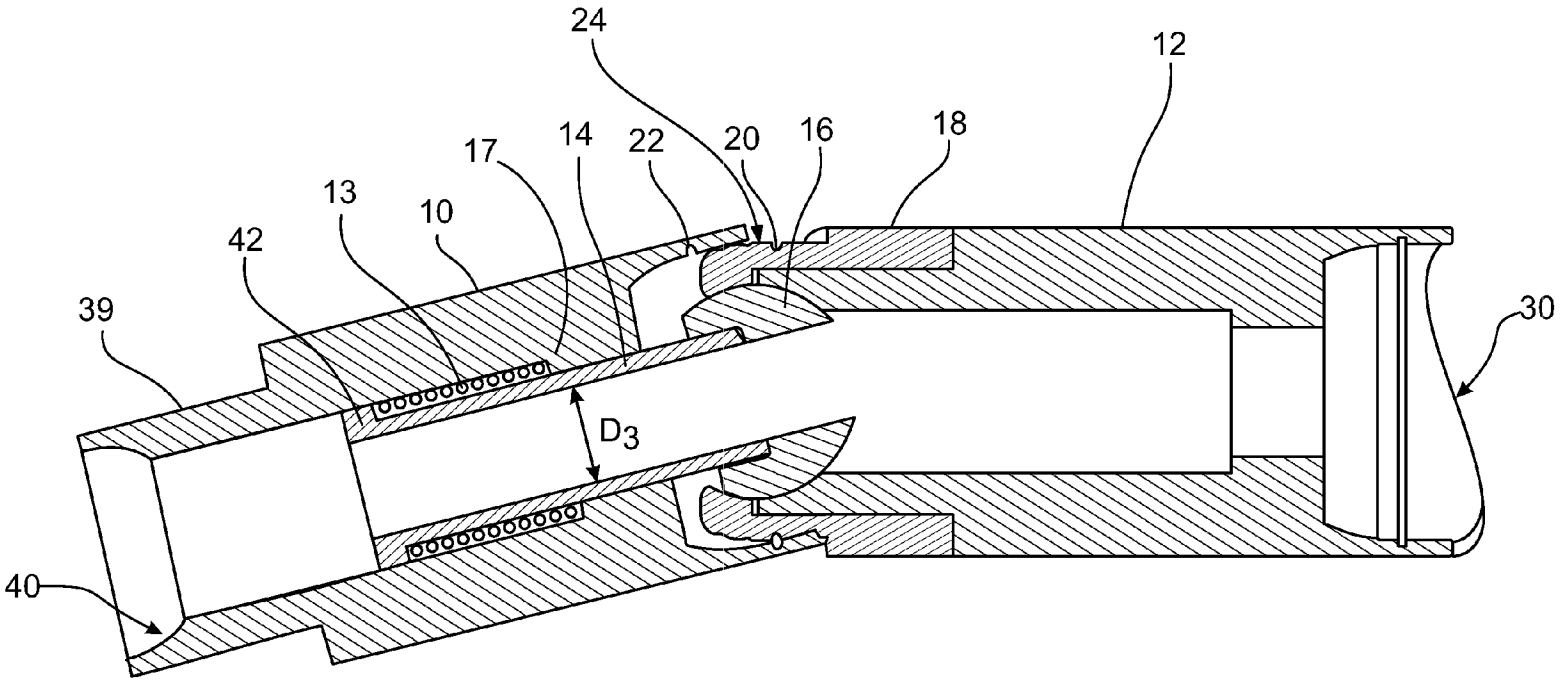
FIG. 2 is a cross section view through adjacent rigid pipe segments in the axially displaced and rotated configuration. Note: the snap ring is not shown.
Figure 3:
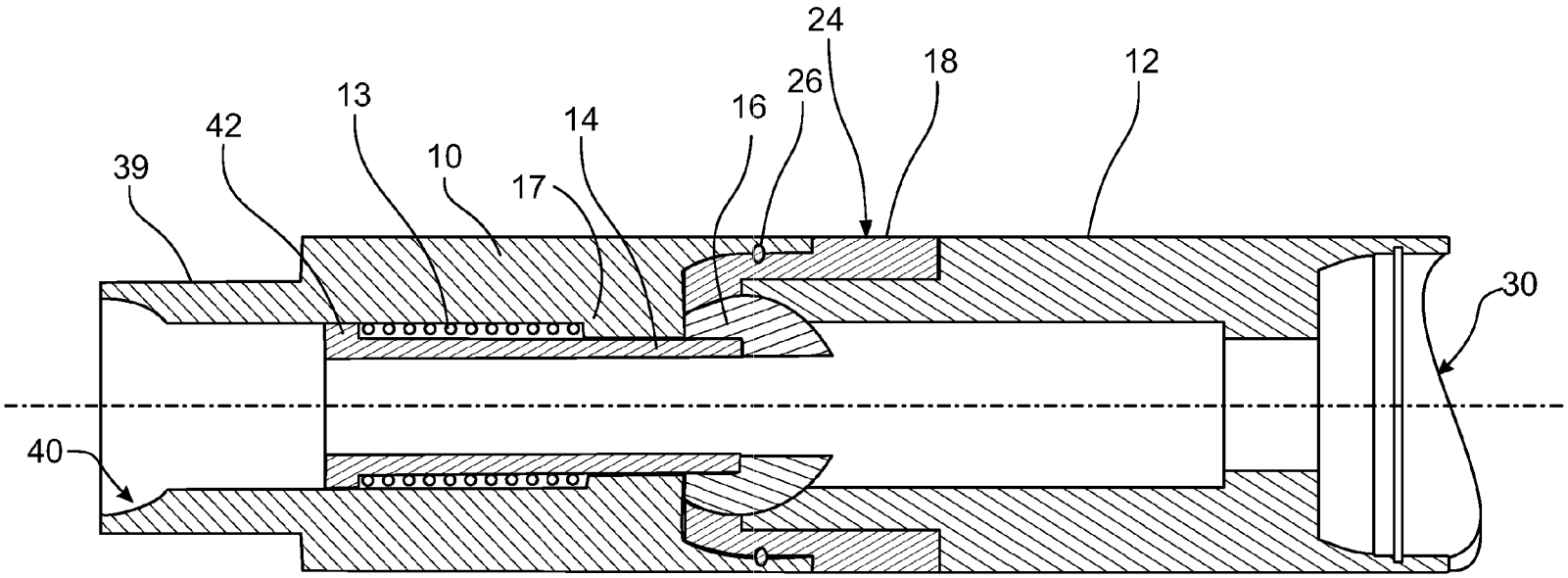
FIG. 3 is a cross-section view through adjacent rigid pipe segments in a mated (assembled) configuration.
Figure 4:
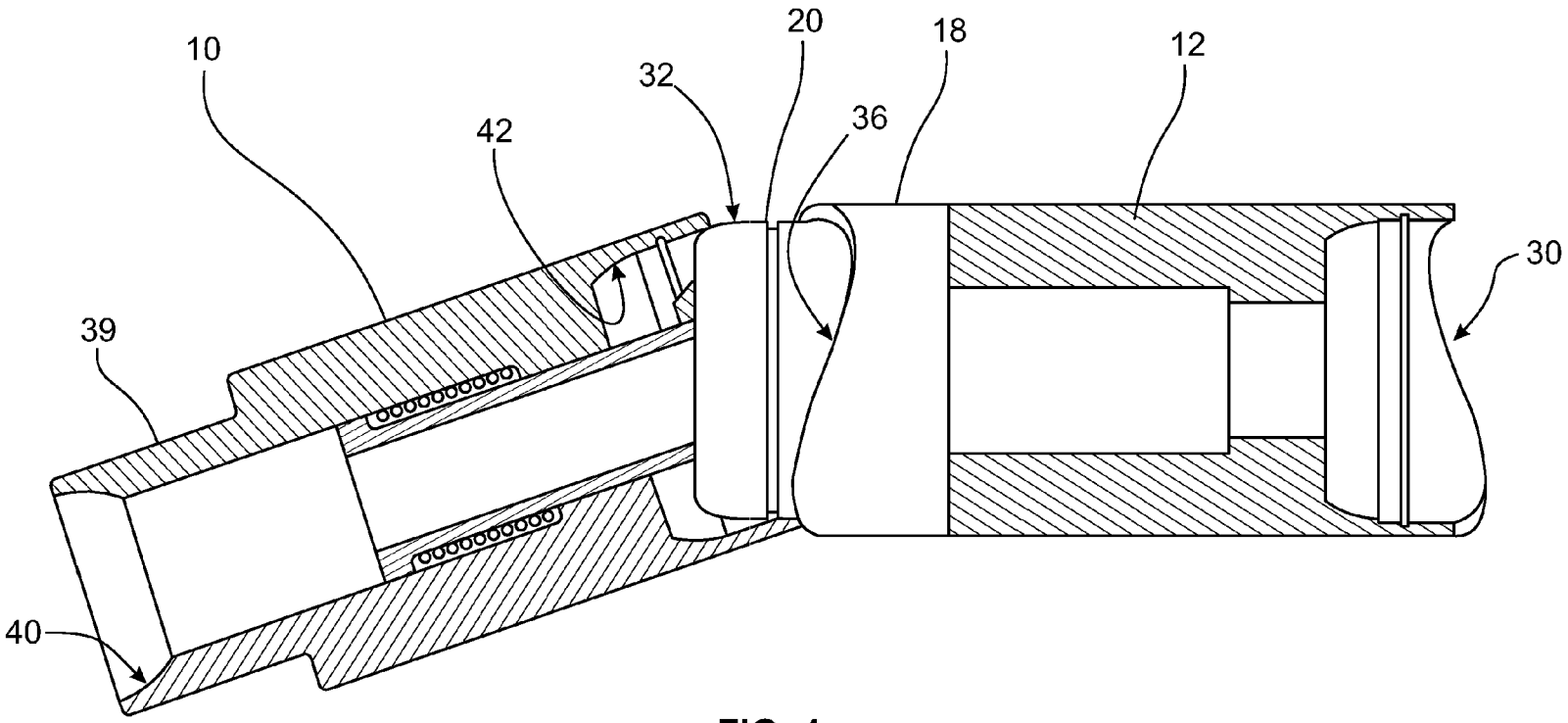
FIG. 4 is a cross section view through adjacent rigid pipe segments in the axially displaced and rotated configuration. Note: the snap ring is not shown.

FIGS. 2, 3 and 4 show cross section views through adjacent rigid pipe segments in the axially-displaced (separated) and rotated configuration (FIGS. 2 and 4), and the self-assembled (i.e., mated and locked) configuration (FIG. 3). Note: the snap ring is not shown in FIGS. 2 and 4. The self-assembling segmented coiled tubing concept comprises a series of short, rigid pipe sections 10, 12 (for example, ranging from 6 to 8 inches long, but can be shorter, or much longer, if needed) having, for example, an outer diameter 2.5 inches, and wall thickness=⅜ to ½ inch thick, which are interconnected by spherical joint 24. The pair of adjacent pipe segments 10, 12 can be axially displaced by pulling on spring-loaded connecting link 14, thereby compressing coil spring 13.

Spherical joint 24 comprises four pieces: connecting link 14, coil spring 13, spherical ball 16, and socket piece 18. In FIGS. 2-4, link 14 and ball 16 are shown as being hollow, with an inner diameter=$D_3$. Axial displacement of the spherical joint 24 allows the spherical joint to become 'active' (i.e., free to rotate) by disengaging and separating the pair of mating contact surfaces 30 and 36. Connecting link 14 comprises a spring-bias means 13 (e.g., a coil spring) for providing a restoring force to pull separated sections back together; for example, after the coiled tubulars have been unwound from the mounting spool; thereby making the unwinding process 'self-assembling". Spring 13 is limited (constrained) at one end by external shoulder (flange) 42 of tube 14, and is limited (constrained) at the other end by internal shoulder 17 of pipe segment 10. Hollow spherical ball 16 is attached to the other end of connecting link 14, after link 14 has been inserted inside of the inner bore of the pipe segment 10. Connecting link 14 can be a hollow tube.

Spherical joint 24 is "hidden", meaning that when the adjacent rigid pipe segments 10 and 12 are mated together (assembled), the spherical joint is completely hidden from view, inside of the pipe segments.

The mating contact surfaces (front-facing surface 30, and rear-facing surface 36) between adjacent segments 10, 12 can have interlocking contact areas 30 and 36 that allow (when touching) for transmission of mechanical thrust and bending moments along the axis of the mated sections. The interlocking mating surfaces can have, for example, an interlocking-type geometry that allows for transmission of torque between mated (assembled) sections. Examples of suitable interlocking-geometries include: semi-circle, semi-oval, sine-wave curve (i.e., wavy curve), spline-curve, fluted castellated curve, sawtooth curve, square-wave, gear-tooth design, or other similar interlocking geometries.

Optionally, the two mating contact surfaces 30 and 36 can be flat (planar), as shown in FIG. 1, with a non-interlocking geometry. In this example, the orientation of the flat contact surfaces 30 and 36 is perpendicular to the centerline axis of the rigid pipe segments. This allows the individual pipe segments 10, 12 to freely rotate about the centerline axis before, and after, being assembled (mated). In this option, no significant torque could be applied to the assembled tubulars (although compressive axial loads can be transmitted, and tensile axial loads can be transmitted if a snap ring is used).

A snap ring 26 (see FIG. 3) can be used in the mated sections to ensure the permanence of the completed joint. Snap ring 26 fits into internal snap ring groove 20 on socket 18, and then snaps into the external snap ring groove 22 in pipe segment 10 when assembled. The use of a snap ring also ensures the mated components do not slip relative to one another during torque transmission, by reacting the axial thrust generated by any inclined surfaces of the interlocking mating surfaces 30 and 36 that transmit the torque.

Optionally, a snap ring does not have to be used. In that case, the assembled joints would remain flexible and rotatable when pulled apart to displace the interlocking-geometry of the mating surfaces. This would allow the assembly to be repeatedly re-coiled around a spool, for example, if needed. However, reduced tensile strength of the drillstring would be expected without using the snap ring (when assembled).

Although not illustrated in the Figures, the design can also include an O-ring, or other type of fluid seal (which can be located, for example, between the snap ring and the inner shoulder of a pipe segment), whereby the internal volume of the mated sections could be sealed from the outer environment and used for fluid conveyance (liquid, gas), or other means.

In another embodiment (not illustrated) the interior volume of the spherical joint 24 (e.g., connecting link 14 and ball 16) is solid, not hollow or tubular.

In FIG. 4, the tapered external contact surface 32 at the male end of socket piece 18 is shaped to smoothly slide into the female end of the adjacent pipe segment 10 along matching interior sliding surface 34. This surface can be lubricated, or made of a low-friction material, to prevent galling.

Additionally, or alternatively, the external bearing surface 34 of the tapered male end of socket 18, and the matching internal bearing surface 34 inside the female end of rigid pipe segment 10 can have an internal fluted (straight-spline, gear-like) type of geometry that resists torsion.

The spherical joint connecting pieces 14, 16 and 18 can be made of steel, brass, aluminum, sintered bronze, plastic, ceramic, or other suitable material. The material can be the same, or different, than the rigid pipe sections. The individual pieces 14, 16 and 18 of spherical joint 24 can be made of the same, or different, materials. For example, tube 14 and ball 16 could be made of a plastic or polymer, while socket piece 18 could be made of metal.

Socket 18 can be attached to rigid pipe segment 12 in a variety of ways, including: threaded connection, brazed, welded, shrink-fit, friction welded, glued, and via a second snap-ring (not illustrated). Likewise, spherical ball 16 can be attached to connecting tube 14 in a variety of ways, including: threaded connection, brazed, welded, shrink-fit, friction welded, glued, and via a third snap-ring (not illustrated).

Bearing (sliding) surfaces can be treated with a low-friction surface treatment or coating, as needed, to prevent galling.

Spring 13 can be a coil spring, wave spring, or other type of spring, as is well known in the art. Alternatively, spring 13 can be an elastic rubber or polymeric material with similar spring resistance to a coil spring.

The self-assembling segmented coiled tubing concept of the present invention is different from rigid tubulars in that it includes self-assembling features. It is different from coiled tubing in that it extends the operating range for bending rates (e.g., allowing a much smaller radius of curvature) and extends the operating range for mechanical load transmission (both forces and torques).

Optionally, the rigid pipe segments 10, 12 can have a non-circular cross-section, such as a triangular, square, oval, or hexagonal cross-section.

Figure 5:
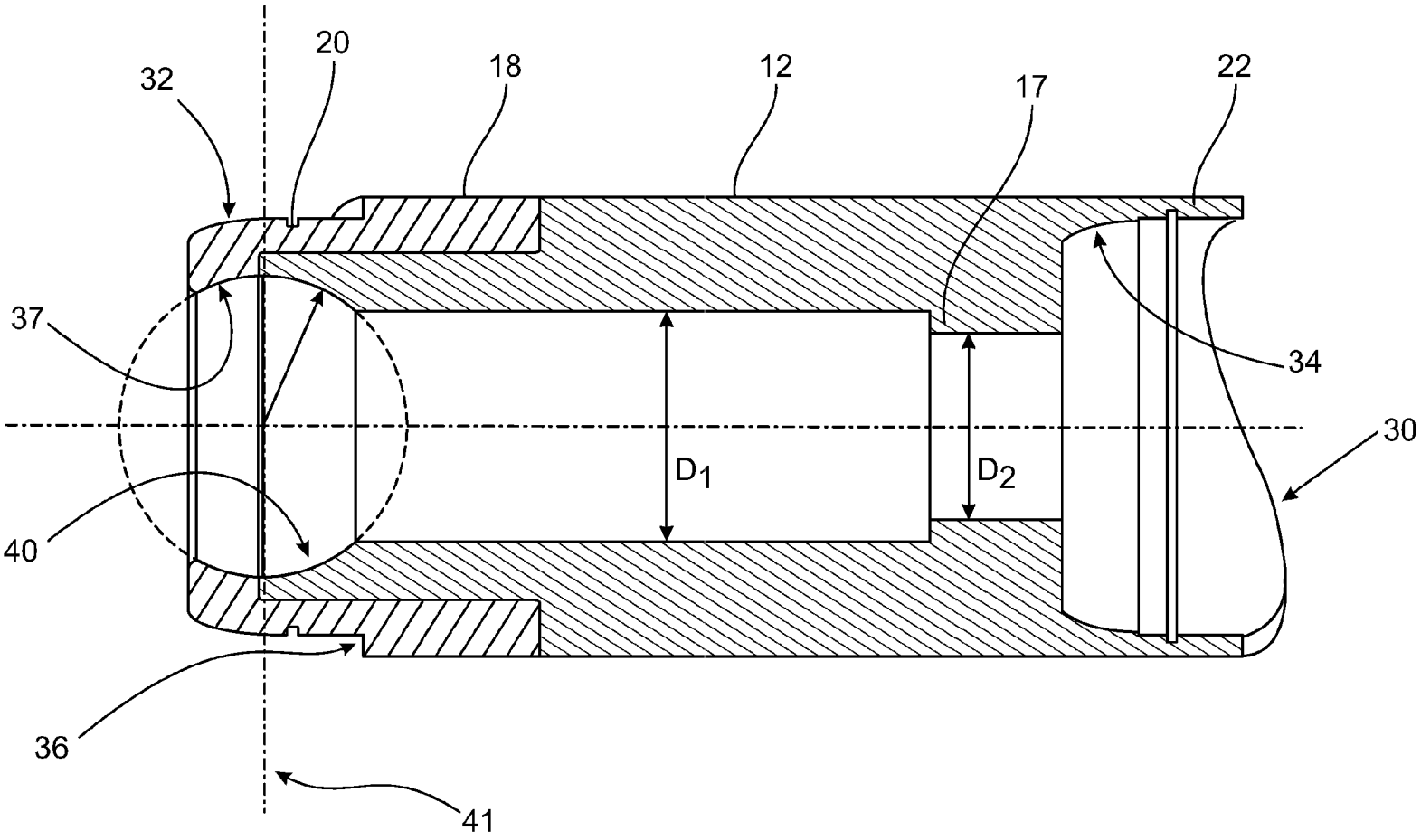
FIG. 5 is a cross-section view through a rigid pipe segment.

FIG. 5 shows a cross-section view of pipe segment 12 and socket piece 18. The interior spherical surface 37 of socket 18 and the interior spherical surface 40 of pipe segment 12 both circumscribe the same circle as the exterior surface of spherical ball 16 (not shown), including the normal manufacturing tolerances for allowing the inner and outer spherical surfaces to slide relative to each other. In other words, interior surfaces 37 and 40 define an interior, semi-spherical cavity (i.e., socket) for the holding ball 16. The center ball 16 is aligned with the end plane 41 of the rear end of pipe segment 12. Alternatively, the center of ball 16 can be slightly offset from the actual end of segment 12 by a few thousandths of an inch (i.e., segment 12 can be undercut).

Figure 6:
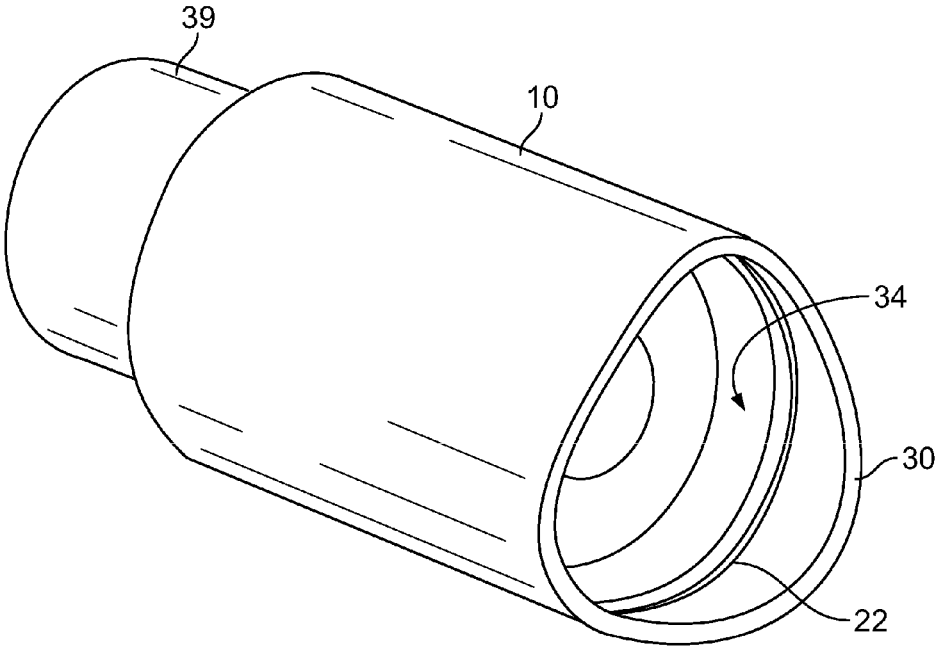
FIG. 6 is a 3-D solid shaded isometric view of a rigid pipe segment.

FIG. 6 is a 3-D solid shaded isometric view of rigid pipe segment 10.

Figure 7:
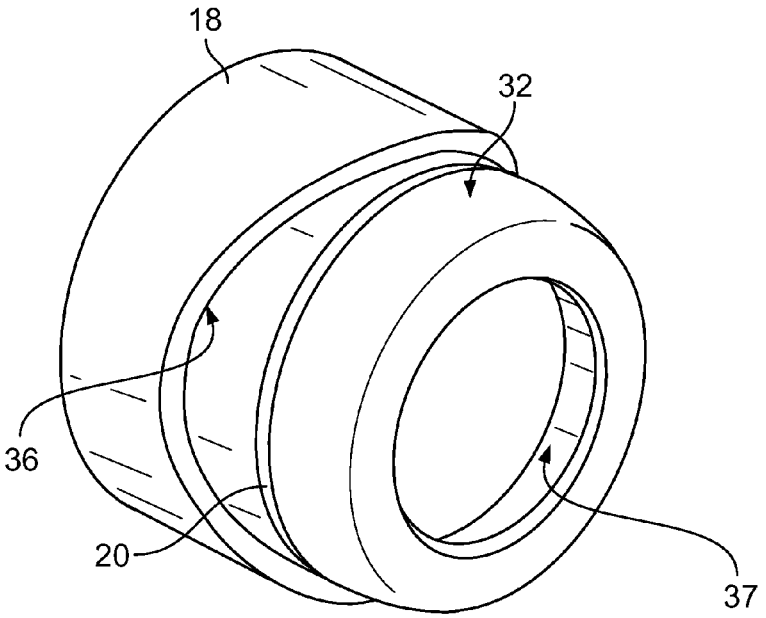
FIG. 7 is a 3-D solid shaded isometric view of a spherical joint socket.

FIG. 7 is a 3-D solid shaded isometric view of spherical joint socket piece 18. Mating surface 36 is shown here as a sine-wave type interlocking shape with, for example, two 'high' spots and two 'low' spots.

Figure 8:
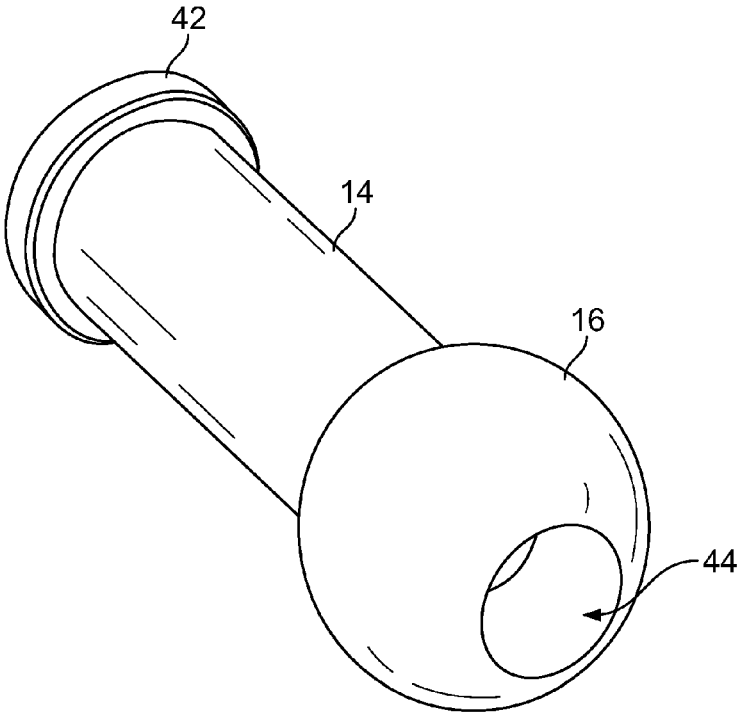
FIG. 8 is a 3-D solid shaded isometric view of a spherical ball joint connector comprising a ball mounted on a connecting link (note: coil spring is not shown).

FIG. 8 is a 3-D solid shaded isometric view of a spherical ball joint connector comprising a ball 16 mounted on a connecting link 14 (note: coil spring is not shown). The connecting tube 14 has a raised external shoulder 42 on the far end to retain the coiled spring. Ball 14 has a hollow interior bore 44.

Figure 9:
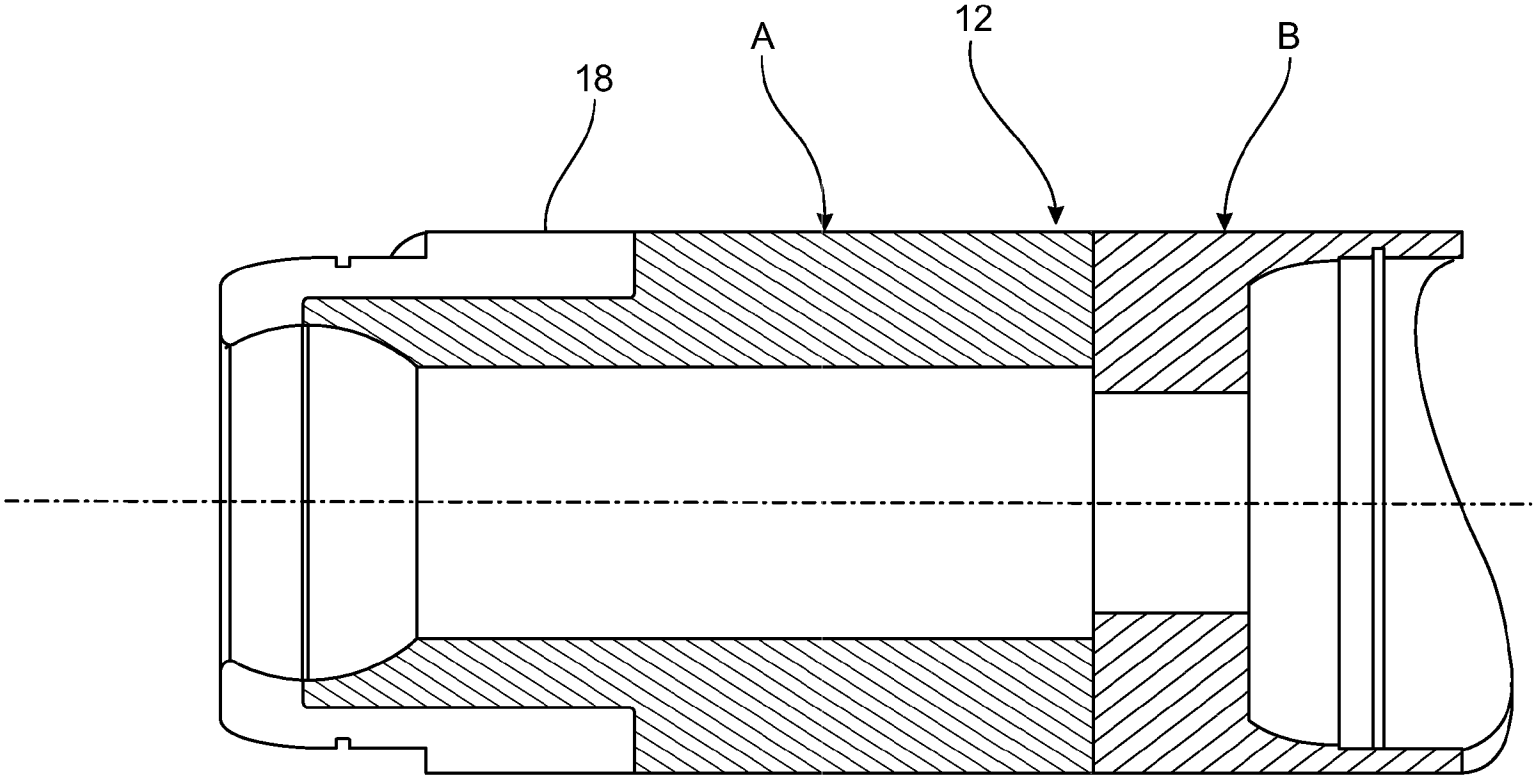
FIG. 9 is a cross-section view through a rigid pipe segment showing two separate parts, A and B, which have been permanently joined together.

In FIG. 9, the rigid pipe segment 12 can optionally comprise two separately-machined parts A and B, where part A can be attached to part B in a variety of ways, including: threaded connection, brazed, welded, shrink-fit, friction welded, glued, and via a second snap-ring (not illustrated).

Figure 10:
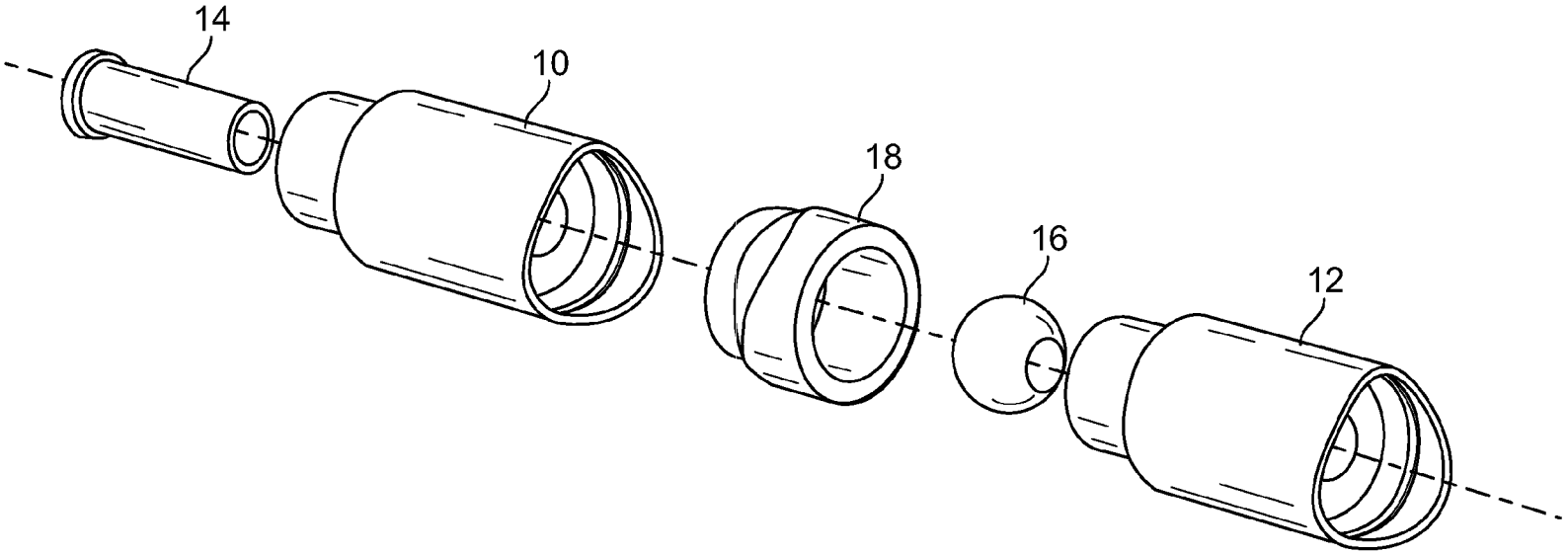
FIG. 10 is an exploded, isometric view of all the parts of the spherical joint for connecting two adjacent rigid pipe segments. Note: the coil spring and snap ring is not shown.

FIG. 10 is a 3-D solid-shaded, isometric, exploded view of all the parts (14, 18, 16) of the spherical joint connecting assembly 24 used for connecting two adjacent rigid pipe segments 10 and 12. Note: coil spring 13 and snap ring 26 are not shown.

Figure 11A:
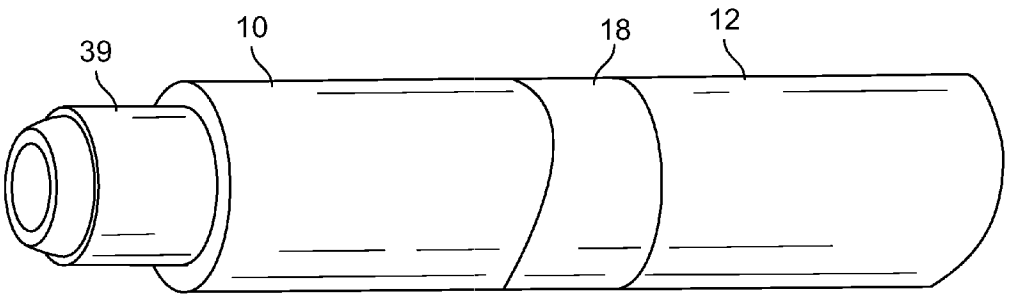
FIG. 11A shows a rapid prototype model (plastic) showing adjacent tubulars mated together.
Figure 11B:
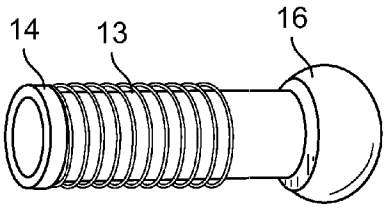
FIG. 11B shows a connecting link including a coil spring and a ball.
Figure 11C:
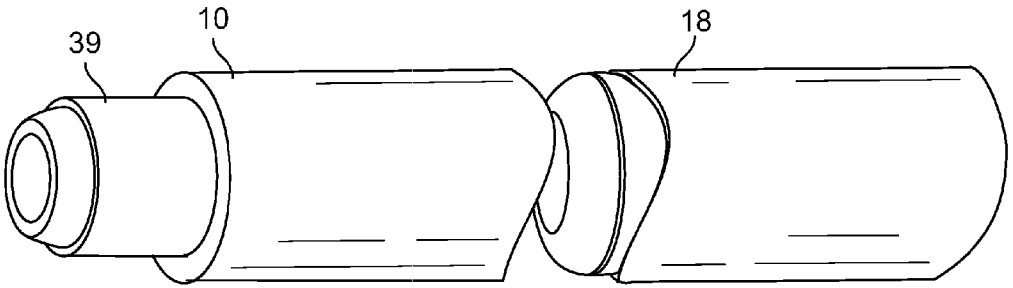
FIG. 11C shows a rigid pipe segment having male insert end, and a socket.

FIG. 11A shows a rapid prototype model (plastic) showing adjacent tubulars mated together. FIG. 11B shows a connecting link including a coil spring and a ball. FIG. 11C shows a rigid pipe segment having male insert end, and a socket.

Figure 12:
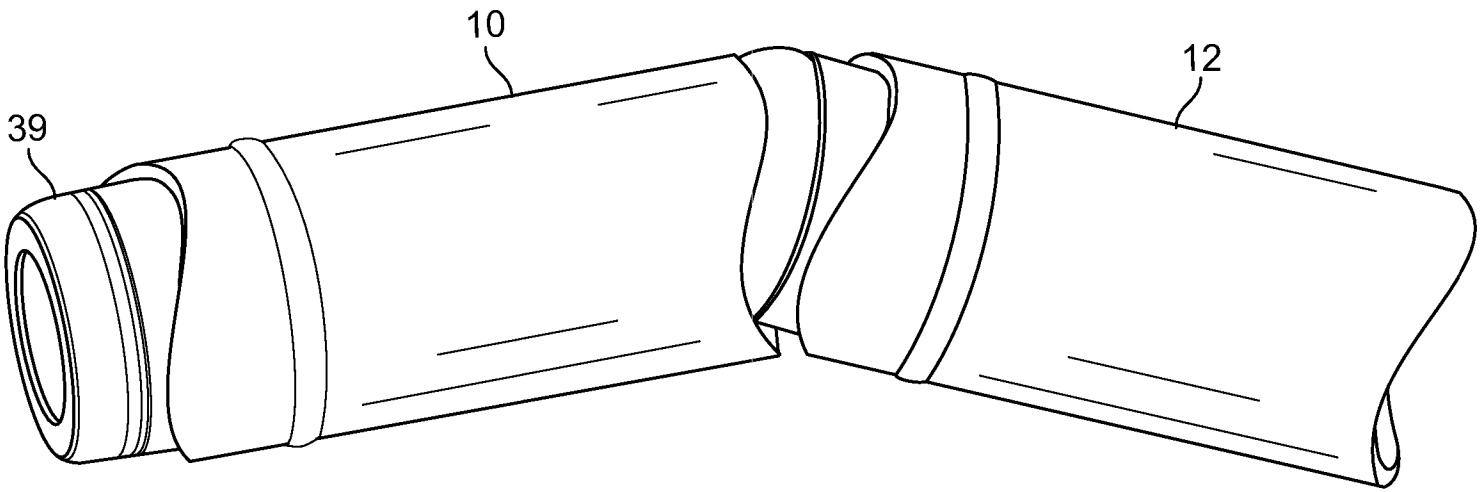
FIG. 12 is a rapid prototype (plastic) model showing the relative motion (rotation and axial displacement) of adjacent tubulars.

FIG. 12 is a rapid prototype (plastic) model showing the relative motion (rotation and axial displacement) of displaced adjacent tubulars. The compressed spring can be seen.

Figure 13:
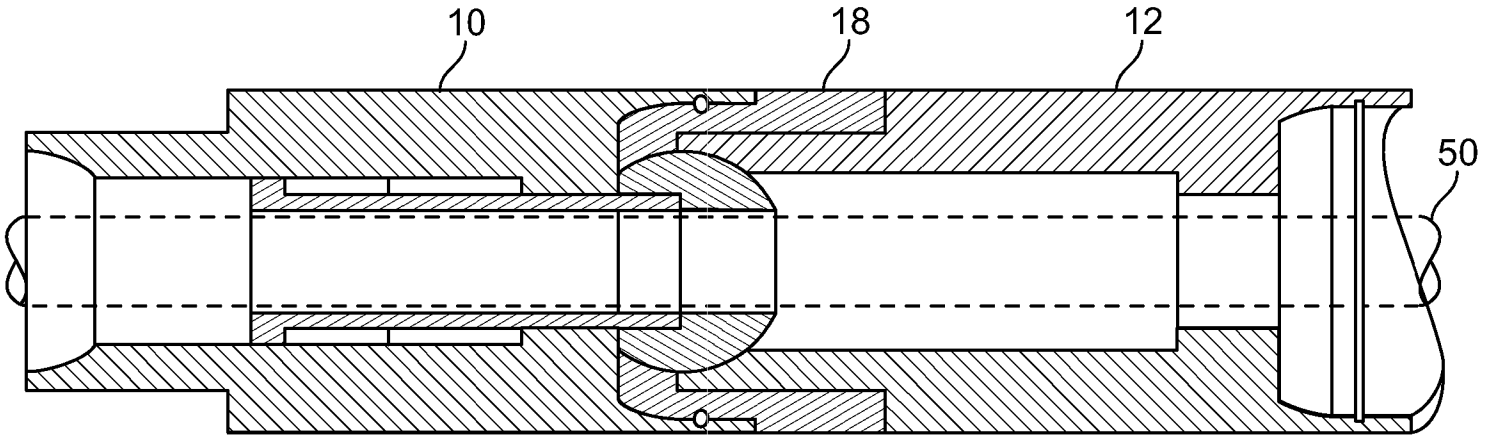
FIG. 13 is a cross-section view through adjacent rigid pipe segments in a mated (assembled) configuration.

FIG. 13 is a cross-section view through adjacent rigid pipe segments in a mated (assembled) configuration. A continuous (i.e., non-jointed) tube 50 has been inserted through the central bore of the assembly.

Figure 14:
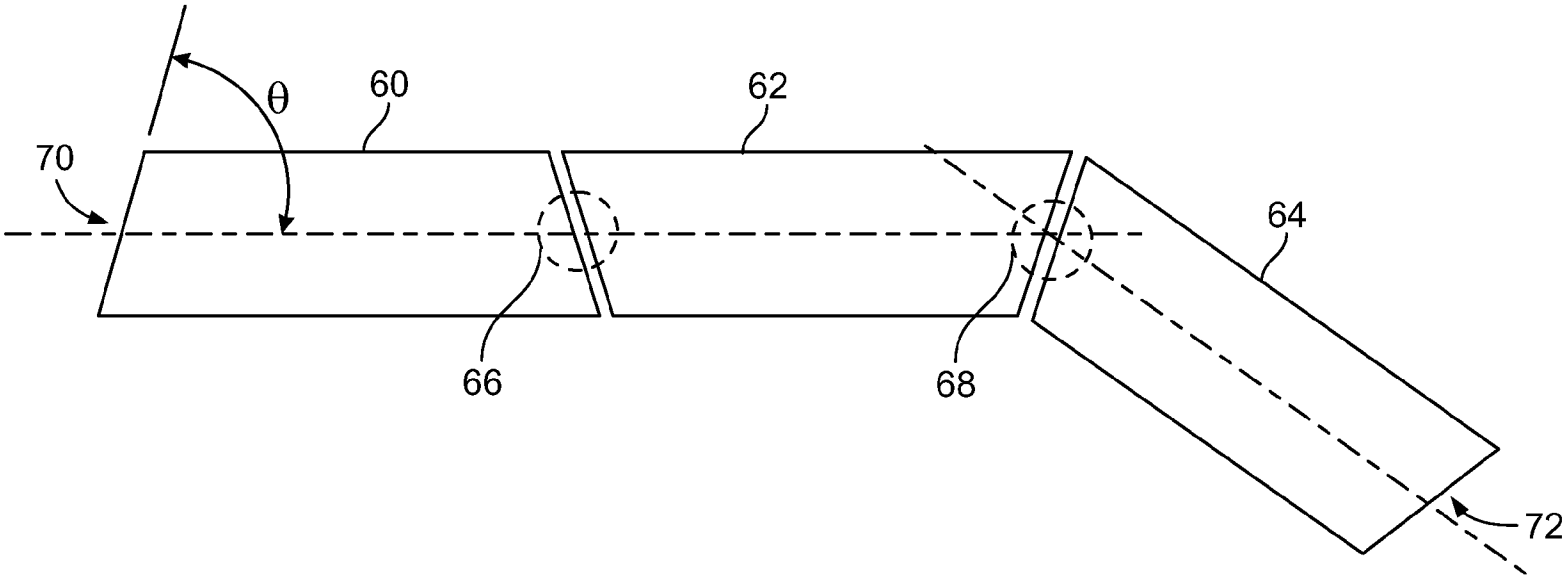
FIG. 14 is a side view through adjacent rigid tubular segments in a mated (assembled) configuration.

FIG. 14 is a side view through three adjacent rigid tubular segments 60, 62, 64, with spherical joints 66 and 68, in a mated (assembled) configuration. The mating contact surfaces (e.g., 70 and 72) are flat, but slanted at an angle, θ, with respect to the pipe's centerline, so that when the individual rigid segments 60, 62, 64 are aligned and connected with snap rings (not shown), the completed assembly is non-straight, depending on the angle of the slanted mating surface.

The particular examples discussed above are cited to illustrate particular embodiments of the invention. Other applications and embodiments of the apparatus and method of the present invention will become evident to those skilled in the art. It is to be understood that the invention is not limited in its application to the details of construction, materials used, and the arrangements of components set forth in the following description or illustrated in the drawings.

What is claimed is:

1. An apparatus, comprising:

a first rigid pipe segment comprising a first end and a second end, the second end having a protrusion;

a second rigid pipe segment having the same shape as the first rigid pipe segment and comprising a second rigid pipe segment first end and a second rigid pipe segment second end, the second rigid pipe segment second end having a second rigid pipe segment protrusion; and a spring-loaded spherical joint directly interconnecting the first rigid pipe segment and the second rigid pipe segment, the spring-loaded spherical joint comprising a first socket connected to the second rigid pipe segment and disposed within a portion of the first rigid pipe segment;

wherein the first socket comprises a first socket first end contacting the second rigid pipe segment second end and a first socket second end contacting the first rigid pipe segment first end when the first and second rigid pipe segments are not separated;

a second socket having the same shape as the first socket and connected to the protrusion of the first rigid pipe segment;

wherein separating the first rigid pipe segment and the second rigid pipe segment along their centerlines activates the spring-loaded spherical joint and allows the first rigid pipe segment and the second rigid pipe segment to freely pivot with respect to each other; and wherein the spring-loaded spherical joint provides a restoring force that pulls the first rigid pipe segment and the second rigid pipe segment in contact with one another and back together after being separated; and wherein the spring-loaded spherical joint further comprises:

a connecting link disposed in the first rigid pipe segment and having a spherical ball at one end;

a spring disposed around the connecting link, wherein the spring is disposed in the first rigid pipe segment; and wherein the first socket comprises an internal semi-spherical cavity for holding the ball;

wherein the ball pivots within the first socket without a rocker cam therebetween.

2. The apparatus of claim 1, wherein the connecting link comprises:

a cylinder with the spherical ball at one end;

a coil spring, having a rear end and a front end, disposed concentrically along the outside of the cylinder; and a flange, located at the other end of the cylinder from the spherical ball, for limiting the travel of the rear end of the coil spring;

wherein the coil spring is trapped between the spherical ball and the flange.

3. The apparatus of claim 2, wherein both the cylinder and the spherical ball are hollow, with the same inner diameter.

4. The apparatus of claim 2, wherein the connecting link is disposed inside of the first rigid pipe segment; and wherein the first rigid pipe segment further comprises an internal shoulder for limiting the travel of the front end of the coil spring.

5. The apparatus of claim 1, further comprising a snap ring for permanently joining together the first rigid pipe segment and the second rigid pipe segment when assembled into a mated configuration; and a pair of grooves for holding the snap ring in place.

6. The apparatus of claim 5, further comprising an O-ring seal disposed in-between the first socket and the first rigid pipe segment for creating a fluid-tight joint when the first rigid pipe segment and the second rigid pipe segment are mated together.

7. The apparatus of claim 1, wherein:

the first end of the second rigid pipe segment comprises a front-facing contact surface;

the first socket second end comprises a rear-facing contact surface; and the front-facing contact surface of the first rigid pipe segment contacts the rear-facing surface of the first socket.

8. The apparatus of claim 7, wherein both the front-facing contact surface of the first rigid pipe segment and rear-facing contact surface of the first socket are flat, and oriented perpendicular to the centerline axis of the first rigid pipe segment and the second rigid pipe segment, respectively.

9. The apparatus of claim 7 wherein the front-facing contact surface of the first rigid pipe segment and rear-facing contact surface of the first socket are flat, and oriented at a slanted angle, θ, which is not perpendicular to the centerline axis of the rigid pipe segment and the second rigid pipe segment, respectively.

10. The apparatus of claim 7, wherein both the front-facing contact surface of the first rigid pipe segment and rear-facing contact surface of the first socket have a curved, interlocking surface shape selected from the group consisting of a semi-circle, semi-oval, sine-wave curve, wavy curve, spline-curve, fluted castellated curve, sawtooth curve, square-wave shape, and gear-tooth curve.

11. The apparatus of claim 1, wherein the center of the ball lies in an end plane of the second rigid pipe segment second end.

12. The apparatus of claim 1, wherein at least one of the first rigid pipe segment and the second rigid pipe segment has a length of from 6 to 8 inches long, and an outer diameter of 2.5 inches.

13. An apparatus, comprising:

a first rigid pipe segment comprising a first end and a second end, the second end having a protrusion;

a second rigid pipe segment having the same shape as the first rigid pipe segment and comprising a second rigid pipe segment first end and a second rigid pipe segment second end, the second rigid pipe segment second end having a second rigid pipe segment protrusion; and a spring-loaded spherical joint interconnecting the first rigid pipe segment and the second rigid pipe segment;

wherein separating the first rigid pipe segment and the second rigid pipe segment along their centerlines activates the spherical joint and allows the two segments to pivot with respect to each other; and wherein the spring-loaded joint provides a restoring force that pulls the first rigid pipe segment and the second rigid pipe segment back together and in contact with one another after being separated;

wherein the spherical joint comprises:

a spring-loaded connecting link with a spherical ball at one end; and a socket rigidly attached to the second rigid pipe segment, with an internal semi-spherical cavity for holding the spherical ball;

wherein the spring-loaded connecting link comprises:

a cylinder with the spherical ball at one end;

a coil spring, having a rear end and a front end, disposed concentrically along the outside of the cylinder; and a flange, located at the other end of the cylinder from the spherical ball, for limiting the travel of the rear end of the coil spring;

wherein the coil spring is trapped between the spherical ball and the flange;

wherein the spring-loaded connecting link is disposed inside of the first rigid pipe segment; and wherein the first rigid pipe segment further comprises an internal shoulder for limiting the travel of the front end of the coil spring;

wherein the center of the spherical ball lies in an end plane of the second end of the second rigid pipe segment; and further comprising a snap ring for permanently joining together the two segments when assembled into a mated configuration; and a pair of grooves for holding the snap ring in place;

wherein the spherical ball pivots within the socket without a rocker cam therebetween.

14. The apparatus of claim 13, wherein both the cylinder and the spherical ball are hollow, with the same inner diameter.

15. The apparatus of claim 13, further comprising an O-ring seal disposed in-between the socket and the first rigid pipe segment for creating a fluid-tight joint when the first rigid pipe segment and the second rigid pipe segment are mated together.

16. The apparatus of claim 13, wherein:

the second rigid pipe segment comprises a second rigid pipe segment first end and a second rigid pipe segment second end;

the second rigid pipe segment first end comprises a second rigid pipe segment first end front-facing contact surface;

the socket is attached to the second end of the second rigid pipe segment;

the socket has a socket front end, a socket tapered rear end, and a socket rear-facing contact surface; and when the first rigid pipe segment and the second rigid pipe segment are mated together, the front-facing contact surface of the first rigid pipe segment first end makes contact with the socket rear-facing surface.

17. The apparatus of claim 16, wherein both the front-facing contact surface of the first rigid pipe segment and the socket rear-facing contact surface are flat, and oriented perpendicular to the centerline axis of the first and second rigid pipe segments.

18. The apparatus of claim 16, wherein both the front-facing contact surface of the first rigid pipe segment and the socket rear-facing contact surface are flat, and oriented at a slanted angle, θ, which is not perpendicular to the centerline axis of the first and second rigid pipe segments.

19. The apparatus of claim 16, wherein both the front-facing contact surface of the first rigid pipe segment and rear-facing contact surface have a curved, interlocking surface shape selected from the group consisting of a semi-circle, semi-oval, sine-wave curve, wavy curve, spline-curve, fluted castellated curve, sawtooth curve, square-wave shape, and gear-tooth curve.

20. An apparatus, comprising:

a first rigid pipe segment comprising a first end and a second end, the second end having a protrusion;

a second rigid pipe segment having the same shape as the first rigid pipe segment and comprising a second rigid pipe segment first end and a second rigid pipe segment second end, the second rigid pipe segment second end having a second rigid pipe segment protrusion; and a spring-loaded spherical joint interconnecting the first rigid pipe segment and the second rigid pipe segment;

wherein separating the first rigid pipe segment and the second rigid pipe segment along their centerlines activates the spherical joint and allows the first rigid pipe segment and the second rigid pipe segment to freely pivot with respect to each other; and wherein the spring-loaded joint provides a restoring force that pulls the first rigid pipe segment and the second rigid pipe segment back together and in contact with one another after being separated;

wherein the spherical joint comprises:

a spring-loaded connecting link with a spherical ball at one end; and a socket rigidly attached to the protrusion of the second rigid pipe segment, with an internal semi-spherical cavity for holding the ball;

wherein the spring-loaded connecting link comprises:

a cylinder with the spherical ball at one end;

a coil spring, having a rear end and a front end, disposed concentrically along the outside of the cylinder; and a flange, located at the other end of the cylinder from the ball, for limiting the travel of the rear end of the coil spring;

wherein the coil spring is trapped between the spherical ball and the flange;

wherein the spring-loaded connecting link is disposed inside of the first rigid pipe segment; and wherein the first rigid pipe segment further comprises an internal shoulder for limiting the travel of the front end of the coil spring;

wherein the center of the ball lies in an end plane of the second end of the second rigid pipe segment;

further comprising a snap ring for permanently joining together the two segments when assembled into a mated configuration; and a pair of grooves for holding the snap ring in place;

wherein both the cylinder and the spherical ball are hollow, with the same inner diameter;

wherein the apparatus further comprises an O-ring seal disposed in-between the socket and the first rigid pipe segment for creating a fluid-tight joint when the two segments are mated together;

wherein the first end of the first rigid pipe segment comprises a front-facing contact surface;

the socket is attached to the second rigid pipe segment second end;

the socket has a socket front end, a socket tapered rear end, and a socket rear-facing contact surface; and when the first rigid pipe segment and the second rigid pipe segment are mated together, the front-facing contact surface of the first rigid pipe segment makes contact with the socket rear-facing surface;

wherein both the front-facing contact surface of the first rigid pipe segment and socket rear-facing contact surface have a curved, interlocking surface shape selected from the group consisting of a semi-circle, semi-oval, sine-wave curve, wavy curve, spline-curve, fluted castellated curve, sawtooth curve, square-wave shape, and gear-tooth curve;

wherein the spherical ball pivots within the socket without a rocker cam therebetween.

21. The apparatus of claim 20, wherein the shape of the interlocking surface is a sine wave curve.

22. The apparatus of claim 20, further comprising a continuous tube or pipe inserted inside of the first and second rigid pipe segments after being mated together.

* * * * *